US009915486B1

(12) United States Patent
Churchill

(10) Patent No.: US 9,915,486 B1
(45) Date of Patent: Mar. 13, 2018

(54) SPENT CASING CATCH AND RELEASE TRAP MECHANISM

(71) Applicant: Craig D. Churchill, Phoenix, AZ (US)

(72) Inventor: Craig D. Churchill, Phoenix, AZ (US)

( * ) Notice: Subject to any disclaimer, the term of this patent is extended or adjusted under 35 U.S.C. 154(b) by 0 days.

(21) Appl. No.: 15/654,189

(22) Filed: Jul. 19, 2017

(51) Int. Cl.
*F41A 9/60* (2006.01)
*F41A 15/16* (2006.01)

(52) U.S. Cl.
CPC ..... *F41A 9/60* (2013.01); *F41A 15/16* (2013.01)

(58) Field of Classification Search
CPC ..... F41A 9/81; F41A 9/60
USPC ..... 42/98; 89/33.4; 206/3
See application file for complete search history.

(56) References Cited

U.S. PATENT DOCUMENTS

| | | | | |
|---|---|---|---|---|
| 4,020,738 | A | 5/1977 | Martinez | |
| 4,715,141 | A | 12/1987 | Kohnke | |
| 4,903,426 | A | 2/1990 | Bammate | |
| 4,954,803 | A | 9/1990 | Iijima et al. | |
| 5,285,593 | A | 2/1994 | Bammate | |
| 5,398,439 | A | 3/1995 | Harless | |
| 6,530,169 | B1 | 3/2003 | Griffin | |
| 2012/0023803 | A1* | 2/2012 | Taylor | F41A 9/60 42/90 |

* cited by examiner

*Primary Examiner* — Reginald S Tillman, Jr.
(74) *Attorney, Agent, or Firm* — Thomas W. Galvani, P.C.; Thomas W. Galvani

(57) ABSTRACT

A receptacle for collecting casings ejected from a firearm applied with a magazine includes a housing having an upper opening, a lower opening, and an interior defined within the housing between and in communication with the upper and lower openings. The upper opening is opened and can be mounted to be spaced apart from the ejection port of a firearm. A gate in the lower opening pivots between open and closed positions; the lower opening is closed when the magazine is received in the firearm and is opened when the magazine is removed from the firearm.

20 Claims, 5 Drawing Sheets

SPENT CASING CATCH AND RELEASE TRAP MECHANISM

FIELD OF THE INVENTION

The present invention relates generally to firearms, and more particularly to firearm accessories for capturing spent ammunition.

BACKGROUND OF THE INVENTION

Ammunition for most firearms has a conventional construction. Generally, firearm ammunition consists of a cartridge which includes components that are consumed and components that must be ejected from the firearm. Conventional cartridges include a jacket or casing, a bullet seated in the casing, propellant contained within the casing behind the bullet, and a primer which ignites the propellant.

The casing is a cylindrical shell with an open front end and a closed rear end. The bullet may have many arrangements, but is often spherical, hemi-spherical, or somewhat conical in shape. The base of the bullet is seated into the front end of the casing, and the casing is crimped or otherwise sealed thereabout, thereby forming an interior of the cartridge. The propellant is carried within this interior. The propellant is a highly incendiary and combustive material; when it is ignited, very hot combustion gases are quickly formed and expand outwardly, causing the casing to expand outward and causing the bullet to burst forward. The primer controls the ignition of the propellant; the primer may be a pressure- or impact-sensitive chemical upon which a firing pin acts.

When a firing pin impacts the primer, the propellant combusts, and the bullet is sent hurtling out of the casing within the barrel of the firearm. The bullet exits the muzzle toward a target. The propellant and the primer are consumed during combustion. The casing, however, is not consumed and not jettisoned from the firearm. Rather, the casing is left expanded within the firing chamber. It must be cleared before a fresh cartridge can be fired.

The casing cools, and as it does, it contracts slightly. Cycling of the firearm will eject the casing. In some firearms, this is done manually by retracting the bolt so that the casing pops out of the ejection port. In other firearms, ejection occurs automatically as a feature of the operating system. With either method, the casing is cleared from the firing chamber so that a new cartridge may be introduced and shot.

Casings are conventionally made from brass, and as such, the community often refers to ejected casings as "spent brass." Spent brass can be a hazard. First, it can get quite hot. As it is ejected, spent brass may drop in place or it may be launched a few inches to feet away, and bystanders hit by hot spent brass can be burned. Second, in an increasingly environmentally-minded world, it is irresponsible to allow spent brass to remain on the ground. A shooter may have quite a bit of spent brass, perhaps several hundred rounds. Leaving hundreds of used casings on the ground is not only unlawful littering, but damages the environment. However, it can be burdensome to pick up casings from the ground after ejection, and it certainly is no way to end an enjoyable shooting trip. One wants to simply set up, shoot, and then leave.

Brass catchers were developed to tackle the problem of spent brass. Conventional brass catchers are mesh nets or bags that can be attached to the top or side of the firearm. As a casing is ejected from the firearm, it enters the bag and is collected. However, a major problem with such brass catchers is the frequency with which they have to be emptied, and the interruption in shooting caused by the emptying. A shooter cannot fire hundreds of rounds nearly continuously; after twenty or thirty rounds, he has to pause, remove the brass catcher from the firearm, and dump its contents into a receptacle. This interrupts the shooting experience. Again, the shooter would most like to simply set up, shoot, and leave. An improved brass catcher which allows the shooter to shoot without interruption is needed.

SUMMARY OF THE INVENTION

The trap uniquely allows the shooter to capture, collect, and dump spent casings without attending to the trap at all. In other words, the shooter need not do anything other than operate the firearm as he normally would to capture, collect, and dump spent casings.

A receptacle for collecting casings ejected from a firearm applied with a magazine includes a housing having an upper opening, a lower opening, and an interior defined within the housing between and in communication with the upper and lower openings. The upper opening is opened and can be mounted to be spaced apart from the ejection port of a firearm. A gate in the lower opening pivots between open and closed positions; the lower opening is closed when the magazine is received in the firearm and is opened when the magazine is removed from the firearm.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1:
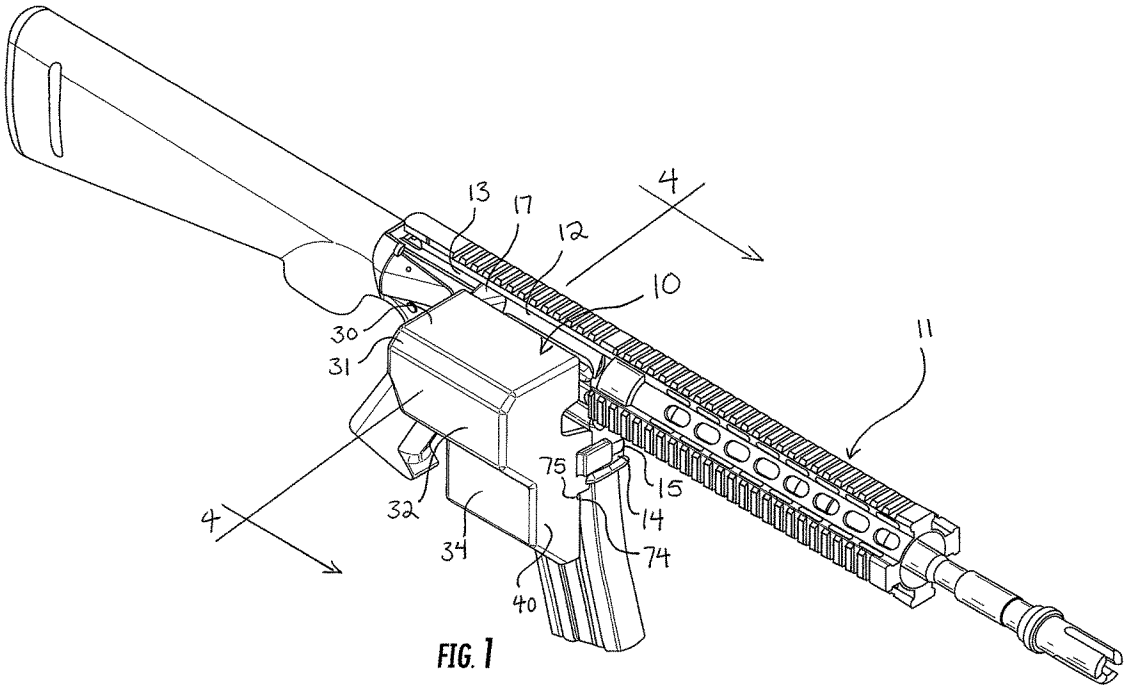
FIG. 1 is a side perspective view showing a spent casing catch and release trap mechanism, or "trap," as it would appear mounted to the side of a firearm.

Reference now is made to the drawings, in which the same reference characters are used throughout the different figures to designate the same elements. FIG. 1 illustrates a spent casing catch and release trap mechanism (hereinafter, "trap" 10) mounted on a firearm 11. The firearm 11 is exemplary of a rifle in the family of rifles including the M-4, M-16, AR-15, and AR-10, which automatically eject a spent casing from an ejection port in the upper receiver 13 after discharging the bullet and cycling the bolt of the firearm 11. The trap 10 is mounted to partially cover the ejection port 12 and the deflector 17 so that spent casings are ejected directly into the trap 10 and maintained therein until they are dumped. With the trap 10, the shooter can capture, collect, and dump spent casings without altering his normal operation and use of the firearm 11 at all.

Figure 2:
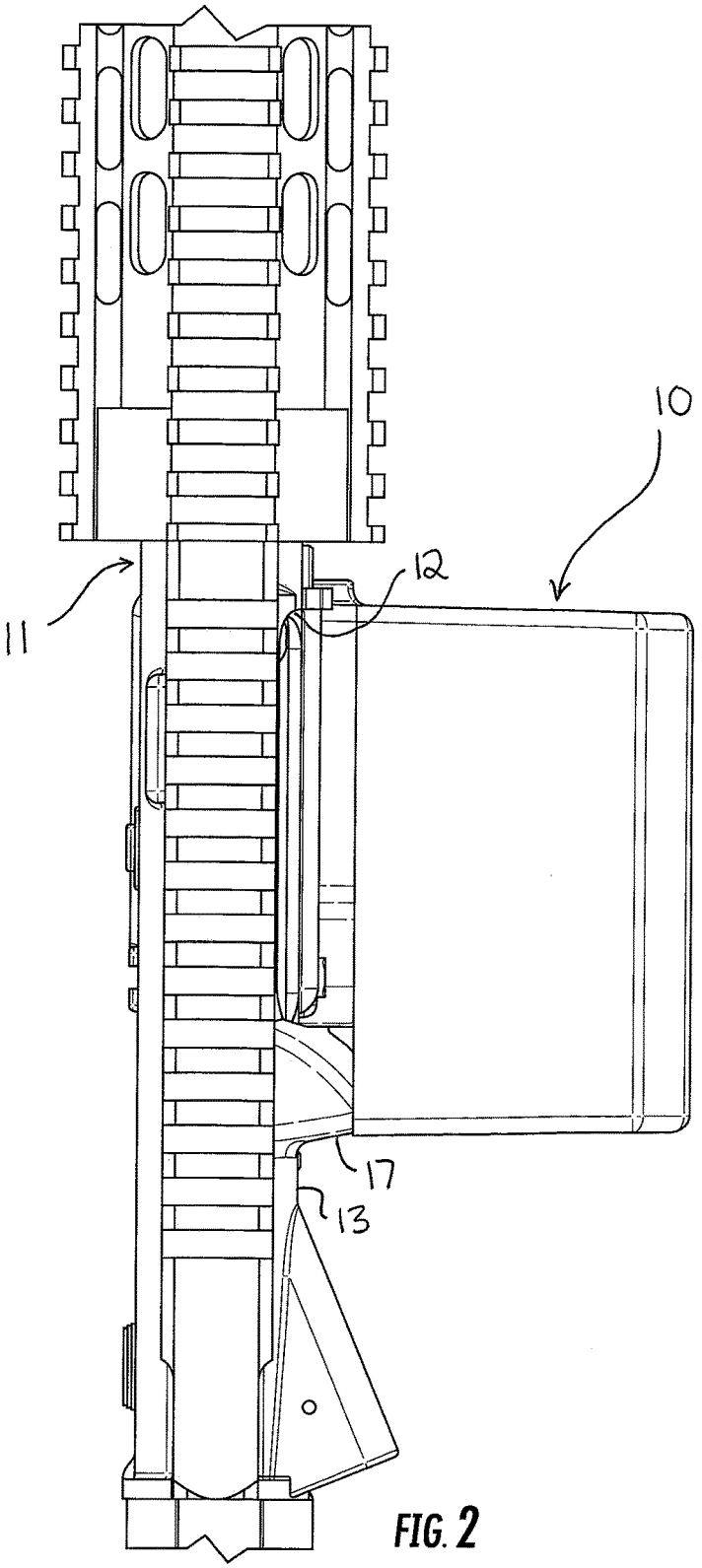
FIG. 2 is a top plan view of the trap of FIG. 1 on the firearm.

The trap 10 is mounted to the side of the firearm 11 and affixed with a strap 15 about the lower receiver 14. The firearm 11 carries a magazine 16 fitted to the lower receiver 14, just to the side of the trap 10. When so positioned, as shown in FIG. 2, the trap 10 is aligned parallel to the upper receiver 14, over the deflector 17, and the top of the trap 10 is just slightly spaced apart from the ejection port 12, so that spent casings are ejected from the ejection port 12 directly into the trap 10, but the trap 10 has an open top to vent heat from the collected casings, as will be described in more detail.

Figure 3:
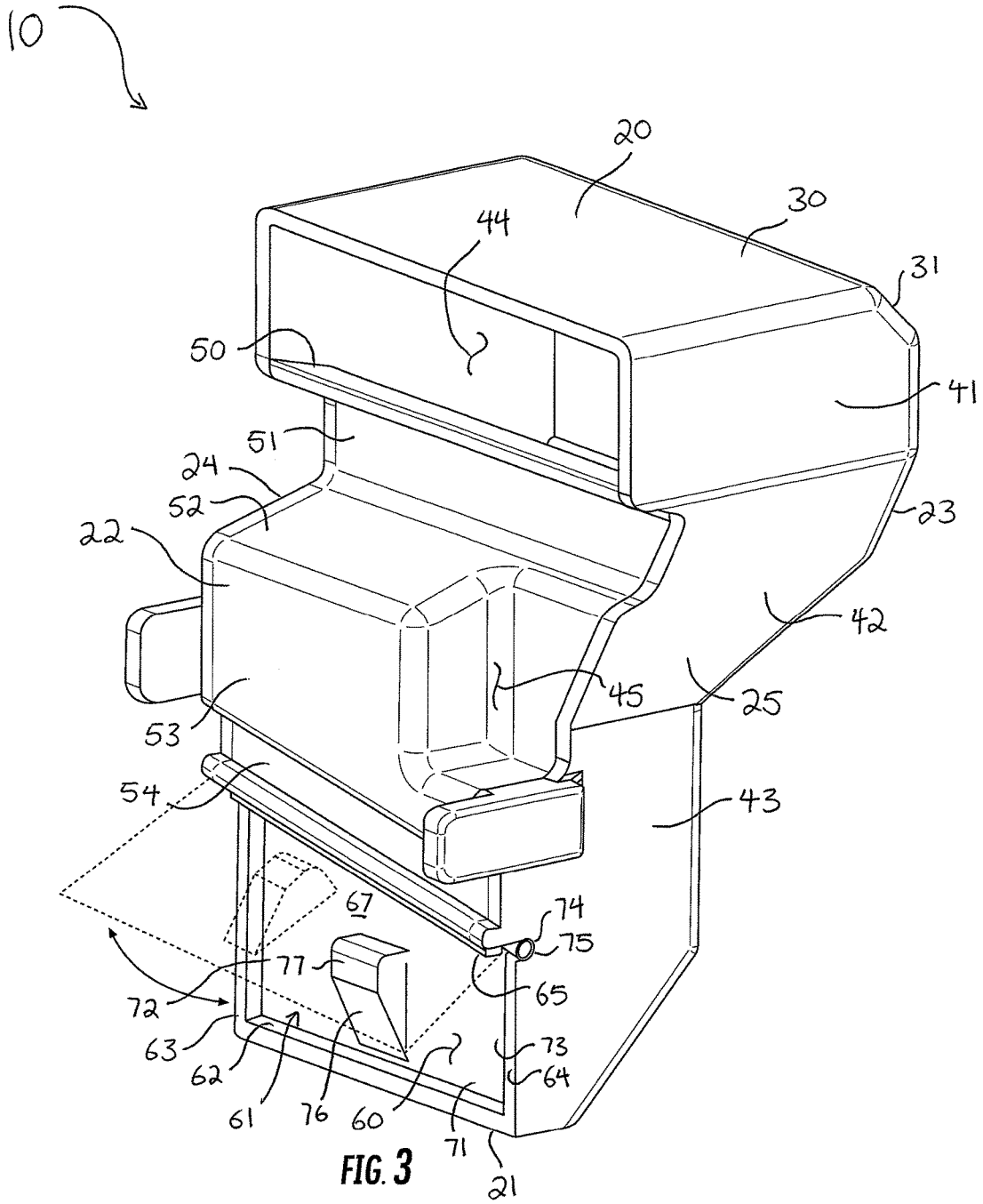
FIG. 3 is a side perspective view of the trap of FIG. 1, removed from the firearm.

Turning now to FIG. 3, the trap 10 is shown in isolation and without its strap 15. The trap 10 is a substantially enclosed receptacle having a top 20, a bottom 21, opposed inner and outer sides 22 and 23, and a front side 24 and opposed rear side 25. The inner and outer sides 22 and 23 each extend from the top 20 to the bottom 21, as do the front and rear sides 24 and 25. The inner, outer, front, and rear sides 22, 23, 24, and 25 are shaped differently; each has a unique arrangement of formations, angles, and indentations which will be described below. The trap 10 has a thin, entirely rigid sidewall 30, constructed from a single piece of material or multiple pieces assembled together, which defines each of the top 20, bottom 21, inner and outer sides 22 and 23, and front and rear sides 24 and 25. As such, the entire trap 10 is rigid. Under one construction technique, the trap 10 may be blow-molded. Under another construction technique, the outer, front, and rear sides 23, 24, and 25 are injection molded together, the inner side 22 is injection molded separately, and the two separate pieces are then fit together. Other manufacturing techniques exist as well.

Figure 4A:
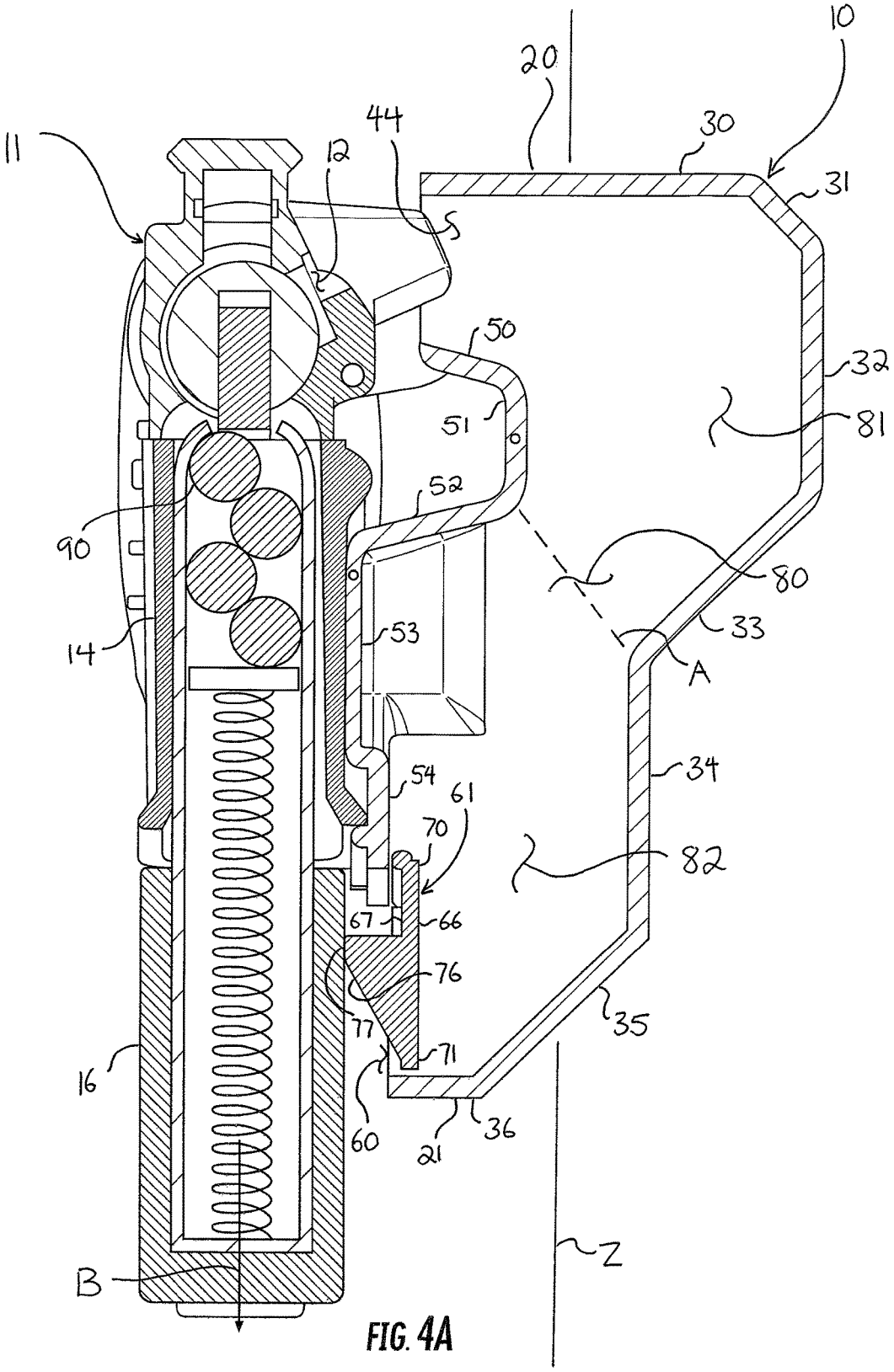
FIGS. 4A and 4B are section views taken along the line 4-4 in FIG. 1, showing use of the trap with the firearm.

Referring to FIG. 3 and also to FIG. 4A, the top 20 of the trap 10 is characterized by a top panel 30, which is flat. Briefly, as shown in FIG. 4A, the trap 10 is mounted to the firearm 11 and then used in an upright position defined by the top 20 directed upwardly and the bottom 21 directed downwardly. The trap 10 has an orientation line Z extending normal to the top panel 30 and through the top 20 and bottom 21, which line Z is oriented vertically in FIG. 4A. This defines the orientation of the trap in a use condition, which is the condition the trap 10 is typically operated. Because the use condition is the typical operational condition of the trap 10, terms like "horizontal" and "vertical" are made with respect to the line Z in this use condition, with "horizontal" indicating a direction generally normal to the line Z and "vertical" indicating a direction generally parallel to the line Z, unless otherwise indicated. As such, the top panel 30 is horizontal: it extends horizontally with respect to the line Z, and normal to the line Z and to the magazine 16 of the firearm. Returning to the discussion of the structure of the trap 10, the top panel 30 extends from the inner side 22 to a diagonal deflection panel 31. The deflection panel 31 is part of the outer side 23. It is oriented transversely with respect to the line Z, extending obliquely downward and outward away from the top panel 30. The deflection panel 31 terminates at the top of an upper panel 32. The upper panel 32 is a major panel, defining in part an upper reservoir described in more detail later. The upper panel 32 is vertical and extends from the deflection panel 31 to a constriction panel 33. The constriction panel 33 is oriented transversely with respect to the line Z, extending obliquely downward and inward away from the upper panel 32, toward the inner side 22. The bottom of the constriction panel 33 terminates at a lower panel 34. The lower panel 34 is a major panel, defining in part a lower reservoir described in more detail later. The lower panel 34 is vertical and extends from the constriction panel 33 to the base panel 35. The base panel 35 is oriented transversely with respect to the line Z, extending obliquely downward and inward away from the lower panel 34, toward the inner side 22. The base panel 35 terminates at the short, horizontal floor panel 36 at the bottom 21 of the trap 10. Each of the top, deflection, upper, constriction, lower, base, and floor panels 30-36 extends fully from the front side 24 to the rear side 25.

The front side 24 of the trap 10 is formed from a single front panel 40, shown in FIG. 1. The rear side 25 of the trap 10 is formed from three panels, shown in FIG. 3: an upper panel 41, a constriction panel 42, and a lower panel 43. The upper panel 41 extends vertically downward from the rear of the top panel 30. The upper panel 41 extends approximately halfway down the upper panel 32, but then transitions into the constriction panel 42, which is oriented obliquely downward and inward away from the upper panel 41, and transversely downward toward the front side 24. It extends obliquely downward roughly to the same vertical distance as the bottom of the constriction panel 33. There, the constriction panel 42 terminates at the lower panel 43, which is a vertical panel extending fully to the bottom 21 of the trap 10.

Referring still primarily to FIGS. 3 and 4A, the trap 10 has at its inner side 22 a mouth panel 50, which is oriented obliquely downward and inward from a mouth 44 of the trap 10. The mouth panel 50 is quite short, and transitions into a vertical upper panel 51, which in turn transitions into a deflection panel 52. The mouth and upper panels 50 and 51 extend fully from the front side 24 to the rear side 25. In this embodiment, however, the deflection panel 52 does not extend similarly fully; rather, as shown in FIG. 3, it extends from the front panel 40 at the front side 24 to a location approximately two-thirds the distance between the front and rear sides 24 and 25. This is because an indentation is formed into the trap 10. The shortened deflection panel 52 partially defines a finger recess 45 at the inner and rear sides 22 and 25.

The finger recess 45 extends into the trap 10 at the inner and rear sides 22 and 25 and provides a space for the shooter's trigger finger to move off of and away from the trigger of the firearm 11, such as into a safety position.

The deflection panel 52 transitions into an L-shaped lower panel 53 which is forward of and also just below the finger recess 45. As such, the lower panel 53 defines the finger recess 45 as well. The finger recess 45 is parallel to the deflection panel 52 and the lower panel 53. The lower panel 53 is vertical. The lower panel has an angled lower edge, from which a short, angled, stub panel 54 extends. The stub panel 54 is vertical but has an angled top and bottom, such that it slopes rearward and downward from the front side 24 to the rear side 25. The stub panel 54 terminates above an opening 60 through the inner side 22.

Figure 4B:
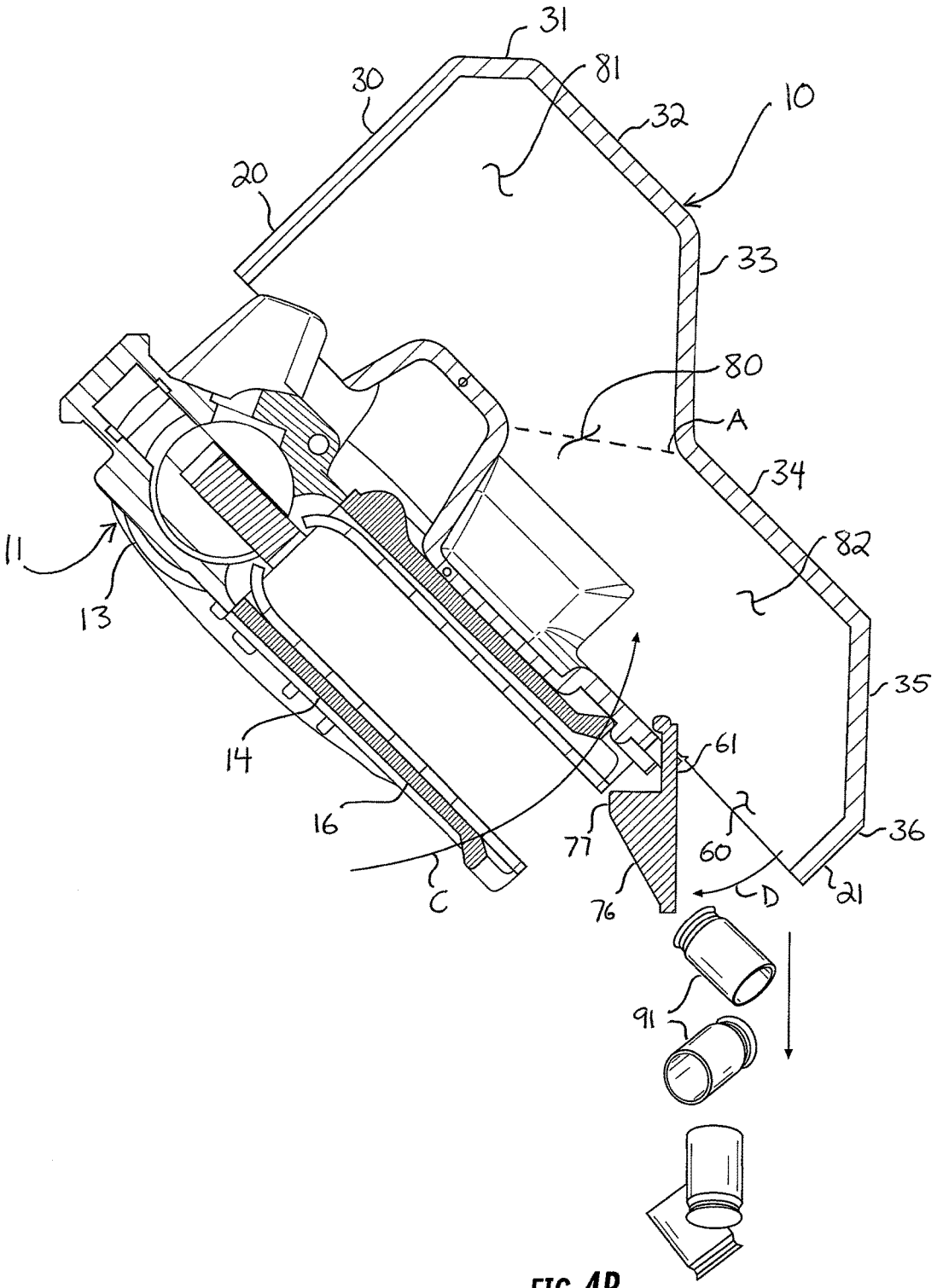

The opening 60 is covered by a gate 61, which is hinged at the bottom of the stub panel 54. The opening 60 is defined by a horizontal bottom 62, vertical front and rear sides 63 and 64, and an angled top 65, all formed in the inner side 22 of the trap 10. The gate 61 is a generally flat, planar, rigid member having a top 70, bottom 71, and opposed front and rear edges 72 and 73. A cylindrical rod 74 is integrally and monolithically formed to the top 70 of the gate 61. The rod 74 projects just beyond the front and rear edges 72 and 73 of the gate 61, and is mounted for rotation in notches 75 formed in the front panel 40 and lower panel 43 at the front and rear sides 24 and 25, respectively. The notches 75 provide a plain bearing fit for the rod 74 and the rod 74 rotates therein, with the gate 61 pivoting in corresponding fashion below the rod 74. The gate 61 pivots between a first, closed position as shown in FIG. 4A, and a second, open position as shown in FIG. 4B, to close and open the opening 60, respectively.

The gate 61 includes opposed inside and outside faces 66 and 67. The inside face 66 is directed into the trap 10 while the outside face 67 is directed out of the trap 10. The inside face 66 is flat, but the outside face 67 is formed with a projection 68 rising outwardly from the outside face 67. The projection 68 includes a sloped lower face 76 and a contact face 77 just above it. The lower face 76 angles upwardly from the surface of the outside face 67 to the contact face 77, which is a small, flat face parallel to the outside face 67. The projection 68 rises off of the outside face 67 a distance so that the contact face 77 is roughly flush with the lower face 53, when the gate 61 is in the closed position thereof. The projection 68 is useful to maintain the proper position of the gate 61 depending on the operational condition of the trap 10, as will be explained.

The panels described above form the four sides of the trap 10. The trap 10 is a substantially enclosed receptacle, and within it is an interior 80 having an upper reservoir 81 and a lower reservoir 82. The interior 80 contains spent casings 91 ejected from the firearm 11. The interior 80 is in communication with the mouth 44 proximate the top 20 of the trap 10 and the opening 60 proximate the bottom of the trap 10, and only openings into the interior 80 are the mouth 44 and the opening 60. As such, spent casings 91 which are ejected into the trap 10 can only exit the trap 10 through two potential outlets: the mouth 44 at the top 20 and the opening 60 at the bottom 21.

When the trap 10 is mounted to the firearm 11 in the preferred position shown throughout the drawings, the mouth 44 is the top of the trap 10. Thus, unless the firearm 11 is turned upside down, which is unlikely, casings 91 collected in the interior 80 will not exit the interior 80 through the mouth 44. Casings will enter the trap 10 through the mouth 44, then drop down into the interior 80. Thus, the only potential outlet from the trap 10 for the casings 91 is through the opening 60 at the bottom 21 of the trap 21.

However, the gate 61 closes the opening 60, and the gate 61 is held in the closed position by the magazine 16. The contact face 77 of the projection 68 is in abutment with the magazine 16, and the gate 61 is thus prevented from swinging open to the opened position. So long as the magazine 16 is received in the firearm 11, the gate 61 cannot and will not swing to the opened position thereof. As such, the gate 61 occludes or closes the opening 60 and casings 91 cannot exit the interior 80. Only when the magazine 16 is removed can casings 91 exit the interior 80.

In operation, the shooter uses the trap 10 to collect spent casings 91. As the drawings show, the trap 10 is coupled to the firearm 11 with a strap 15 wrapped about the lower receiver 14. The trap 10 is removable, as the strap 15 can be disconnected, but in practice, the trap 10 does not need to be removed from the firearm 11, and indeed, the shooter typically prefers not to remove it from the firearm 11. The trap 10 uniquely allows the shooter to capture, collect, and dump spent casings 91 without attending to the trap 10 at all; the shooter only has to fire and reload. In other words, the shooter need not do anything other than operate the firearm 11 as he normally would to capture, collect, and dump spent casings 91.

When the trap 10 is properly mounted on the firearm 11, the mouth 44 is registered with and spaced slightly apart from the ejection port 12. The mouth 44 does extend over the deflector 17, such that the deflector projects into the mouth 44 slightly at the rear side 25 of the trap 10. The magazine 16 is applied to the firearm 11, and so cartridges 90 are available to be loaded into the firing chamber of the firearm 11. Each cartridge 90 is successively and automatically loaded into the firing chamber, the firearm 11 is fired, and the spent casing 91 is ejected through the ejection port 14. It travels directly into the mouth 44. The spent casing 91 ricochets off either or both of the top panel 30 and the deflection panel 31. Either way, the casing 91 is directed downward into the lower reservoir 82. The upper reservoir 81 is one large portion of the interior 80, and the lower reservoir 82 is another. The upper and lower reservoirs 81 and 82 are separated generally by an area shown by the broken line A in FIG. 4A, which is a constriction point between the constriction panel 33 and the corner of the upper panel 51 and the deflection panel 52. The lower reservoir 82 is large enough to hold casings 91 from most large-capacity magazines. Thus, in use, the collected casings 91 will rarely, if ever, stack up to above the line A into the upper reservoir 81.

The upper reservoir 81 is useful for holding a volume of air. Because the mouth 44 is not closed and is permanently open or opened, the upper reservoir 82 exchanges ambient air with the environment. Further, because the mouth 44 is spaced apart from the firearm 11, the upper reservoir 82 exchanges ambient air with the environment. As such, casings 91 that are ejected into the interior 80 cool as they move through the mouth 44, through the upper reservoir 81, and into the lower reservoir 82. Once collected in the lower reservoir 82, the heat from them rises to the upper reservoir 81 and then exits through the mouth 44. In this way, the collected casings 91 cool down.

The shooter fires the firearm 11 until the magazine of cartridges 90 is depleted. Each spent casing 91 is captured by the trap 10 and collected in the lower reservoir 82 where it is maintained until the shooter has depleted the magazine 16. When the magazine 16 has been depleted and all the casings 91 have been ejected, the magazine 16 is removed.

The shooter releases the magazine 16 and then draws it outward from the lower receiver 14 along the line B in FIG. 4A. Briefly, it is noted that FIG. 4A is a section view showing the trap 10 applied to the firearm 11, with the magazine 16 about to be removed. No casings 91 are shown collected in the magazine 16, but one having ordinary skill in the art will understand that the lower reservoir 82 is actually filled with casings 91. The casings 91 are not shown simply for clarity of the illustration. Returning to the description of the option, when the magazine 16 is removed from the firearm 11, nothing bounds the gate 61 on the firearm 11 side. As such, the gate 61 is free to pivot outward from the closed position to the open position.

The casings 91 empty from the trap 10 in response to the magazine 16 being removed. The weight of the casings 91 collected in the lower reservoir 82 will cause the gate 61 to open. Because the base panel 35 is oriented transversely with respect to the line Z, extending obliquely downward and inward away from the lower panel 34, toward the inner side 22, the casings 91 which are collected in the lower reservoir 82 are urged by gravity downward and toward the opening 60. Should a very high-capacity magazine 16 have been used and the spent casings 91 have collected to above the line A into the upper reservoir 81, then the transversely-oriented constriction panel 33 urges casings 91 downward and inward from the upper panel 32, toward the inner side 22, and thus ultimately toward the opening 60. To assist in the emptying of the trap 10, the shooter may tilt the firearm 11 slightly to the right along the line C as shown in FIG. 4B. This ensures that the weight of the casings 91 pushes the gate 61 open along the line D into the opened position of the gate 61, thereby fully and widely opening the opening 60. The casings 91 spill out of the trap 10. Typically, a shooter will have a collection bucket underneath the firearm 11, so that the casings dumped from the trap 10 are collected. The trap 10 typically takes approximately less than one second to empty a full interior 80 when the casings 91 are dumped in this manner.

Once the magazine 16 has been removed, and the trap 10 is empty, a fresh magazine 16 can be applied to the firearm 11. A new magazine is applied to the firearm 11 by registering the top of the magazine with a magazine slot in the lower receiver 82. The magazine is then directed upward into the slot. As the shooter moves the magazine upward, the outer wall of the magazine contacts the sloped lower face 76 of the projection 68. Because the projection 68 projects outwardly from the outside face 67 of the gate 61, and because the magazine is inserted in a defined manner vertically upward and cannot deviate laterally, the magazine causes the gate 61 to move. As the fresh magazine moves upward, it slides up the sloped lower face 76, urging the gate 61 back to closed position thereof. Once the magazine is fully installed in the lower receiver 14, the magazine is against the contact face 77, and the gate 61 is fully pivoted back to the closed position. The opening 60 is thus closed and any casings 91 caught by the trap 10 will be collected therein. As such, the firearm 11 and the trap 10 are ready for use.

The foregoing description shows that no new or additional action is necessary to collect and then dump spent casings 91. The shooter performs all the actions he conventionally does when firing the firearm 11: he aims and fires until the magazine 16 runs empty, then reloads with a fresh magazine. Merely removing the magazine 16 from the firearm 11 allows the casings 91 to empty automatically from the trap 10. Then, the shooter inserts a new magazine with new cartridges. Doing so moves the gate 61 back to the closed position so that the trap 10 is reset and ready to again collect casings 91.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that such modifications do not depart from the spirit of the invention, they are intended to be included within the scope thereof.

The invention claimed is:

1. A receptacle for collecting casings ejected from a firearm, the firearm having an ejection port and a receiver and being applied with a magazine, the receptacle comprising:

a housing having an upper opening, a lower opening, and an interior defined within the housing between and in communication with the upper and lower openings;

the upper opening is opened; and wherein the housing being configured to be attached to the receiver such that, in use with the firearm, the upper opening is configured to be adjacent the ejection port and the lower opening is configured to extend below the receiver and wherein the housing is configured such that the lower opening is closed when the magazine is received in the firearm and is opened when the magazine is removed from the firearm.

2. The receptacle of claim 1, wherein the housing is rigid.

3. The receptacle of claim 1, further comprising:

opposed outer and inner sides of the housing;

an outer wall of the housing extends along the outer side of the housing; and the outer wall is oriented obliquely at the top and bottom of the housing.

4. The receptacle of claim 3, further comprising upper and lower reservoirs of the interior, separated by a constriction, wherein the outer wall is oriented obliquely between the upper and lower reservoirs.

5. The receptacle of claim 1, further comprising:

a gate mounted in the lower opening which moves between an open position and a closed position with the respect to the lower opening; and a projection formed on the gate which contacts the magazine when the magazine is received in the firearm.

6. The receptacle of claim 5, wherein the projection has a sloped lower face.

7. A receptacle for collecting casings ejected from a firearm, the firearm having an ejection port and a receiver and being applied with a magazine, the receptacle comprising:

a housing having an upper opening, a lower opening, and an interior defined within the housing between the upper and lower openings;

the upper opening is opened; and wherein the housing being configured to be attached to the receiver such that, in use with the firearm, the upper opening is configured to be adjacent the ejection port and wherein the lower opening is configured to extend below the receiver and wherein the housing is configured such that a gate is mounted to the lower opening to pivot between a closed position and an open position in response to the application and removal of the magazine from the firearm respectively.

8. The receptacle of claim 7, wherein the housing is rigid.

9. The receptacle of claim 7, further comprising:

opposed outer and inner sides of the housing;

an outer wall of the housing extends along the outer side of the housing; and the outer wall is oriented obliquely at the top and bottom of the housing.

10. The receptacle of claim 9, further comprising upper and lower reservoirs of the interior, separated by a constriction, wherein the outer wall is oriented obliquely between the upper and lower reservoirs.

11. The receptacle of claim 9, further comprising:

an inner wall of the housing extends along the inner side of the housing; and a finger recess is formed into the inner wall, extending parallel to the inner wall.

12. The receptacle of claim 7, further comprising a projection formed on the gate which contacts the magazine when the magazine is received in the firearm.

13. The receptacle of claim 12, wherein the projection has a sloped lower face.

14. A receptacle for use with a firearm having an ejection port and a receiver, the firearm using a magazine, the receptacle comprising:

a housing having a top, a bottom, an inner side, an opposed outer side, an interior defined within the housing and extending between the top and bottom, and opposed upper and lower reservoirs of the interior;

an upper opening in the housing on the inner side proximate the top, the upper opening leading to the interior; and a lower opening in the housing on the inner side proximate the bottom, the lower opening leading to the interior;

wherein the housing being configured to be attached to the receiver such that, in use with the firearm, the upper opening is configured to be adjacent the ejection port of the firearm and wherein the lower opening is configured to extend below the receiver and wherein the housing is configured such that a gate mounted to the lower opening for pivoting between a closed position when the magazine is received in the firearm and an open position when the magazine is removed from the firearm.

15. The receptacle of claim 14, wherein the housing is rigid.

16. The receptacle of claim 14, further comprising:

an outer wall of the housing extends along the outer side of the housing; and the outer wall is oriented obliquely at the top and bottom of the housing.

17. The receptacle of claim 16, wherein the outer wall is oriented obliquely between the upper and lower reservoirs.

18. The receptacle of claim 14, further comprising:

an inner wall of the housing extends along the inner side of the housing; and a finger recess is formed into the inner wall, parallel to the inner wall.

19. The receptacle of claim 14, further comprising a projection formed on the gate which contacts the magazine when the magazine is received in the firearm.

20. The receptacle of claim 19, wherein the projection has a sloped lower face.

* * * * *